US006033047A

United States Patent [19]

Hoffman

[11] Patent Number: 6,033,047

[45] **Date of Patent: *Mar. 7, 2000**

[54] DRAWER SLIDE ASSEMBLY

[75] Inventor: Keith A. Hoffman, Hudsonville, Mich.

[73] Assignee: Knape & Vogt Manufacturing Company, Grand Rapids, Mich.

[ * ] Notice: This patent is subject to a terminal disclaimer.

[21] Appl. No.: 09/136,460

[22] Filed: Aug. 19, 1998

Related U.S. Application Data

[63] Continuation of application No. 08/583,758, Jan. 11, 1996, Pat. No. 5,868,479, which is a continuation of application No. 08/109,690, Aug. 20, 1993, Pat. No. 5,507,571, which is a continuation-in-part of application No. 07/934,423, Aug. 24, 1992, Pat. No. 5,316,389, and application No. 07/932,718, Aug. 20, 1992, abandoned, which is a continuation of application No. 08/233,531, Apr. 26, 1994, Pat. No. 5,472,272.

[51] Int. Cl.[7] ..... A47B 88/00

[52] U.S. Cl. ..... 312/334.44; 312/334.46

[58] Field of Search ..... 312/334.44, 334.46, 312/334.8, 334.16, 334.7, 334.11, 333; 384/18, 19, 21, 34, 22

[56] References Cited

U.S. PATENT DOCUMENTS

| | | | |
|---|---|---|---|
| 1,071,006 | 8/1913 | Little | 312/334.8 X |
| 2,277,702 | 3/1942 | Kennedy . | |
| 2,277,703 | 3/1942 | Kennedy . | |
| 2,859,070 | 11/1958 | Gomersall . | |
| 2,981,584 | 4/1961 | Friend . | |
| 3,092,429 | 6/1963 | Barnes . | |
| 3,123,419 | 3/1964 | Maxwell . | |
| 3,141,714 | 7/1964 | Valitus . | |
| 3,142,517 | 7/1964 | Ward . | |
| 3,243,247 | 3/1966 | Knape . | |
| 3,259,447 | 7/1966 | Deutsch . | |
| 3,278,250 | 10/1966 | Vogt . | |
| 3,589,778 | 6/1971 | Olson . | |
| 3,782,800 | 1/1974 | Remington . | |
| 3,937,531 | 2/1976 | Hagen . | |
| 3,954,315 | 5/1976 | Sanden . | |
| 3,995,927 | 12/1976 | Stein . | |
| 4,065,196 | 12/1977 | Stein . | |
| 4,274,689 | 6/1981 | VanderLey . | |
| 4,370,007 | 1/1983 | Fler | 312/333 X |
| 4,423,914 | 1/1984 | VanderLey . | |
| 4,441,772 | 4/1984 | Fielding . | |
| 4,469,384 | 9/1984 | Fler et al. | 384/18 X |
| 4,473,262 | 9/1984 | Staye . | |
| 4,480,878 | 11/1984 | Leiper . | |
| 4,560,212 | 12/1985 | Papp . | |
| 4,610,487 | 9/1986 | Delmage et al. | 384/18 |
| 4,662,761 | 5/1987 | Hoffman . | |
| 4,765,669 | 8/1988 | Bessinger . | |
| 4,988,214 | 1/1991 | Clement | 384/18 |
| 5,181,781 | 1/1993 | Wojcik | 312/334.44 X |
| 5,316,389 | 5/1994 | Hoffman | 384/21 X |
| 5,484,209 | 1/1996 | Wing | 384/18 |

*Primary Examiner*—Peter M. Cuomo
*Assistant Examiner*—Janet M. Wilkens
*Attorney, Agent, or Firm*—Price, Heneveld, Cooper, DeWitt and Litton

[57] ABSTRACT

A drawer slide assembly for supporting a drawer on a cabinet in which the slide channels include in-stop elements at the outer ends to facilitate positioning and assembly of the drawer slide assembly. At least one anti-scrape polymeric guide bushing is located at the outer ends of the channels in order to reduce binding and scraping of the slide channels.

5 Claims, 8 Drawing Sheets

10
40
16
32
84
14
72
22
20
18
VI
VI
56
52
50
54'
12
54
52'
26
24
30
13
164
160
17
162

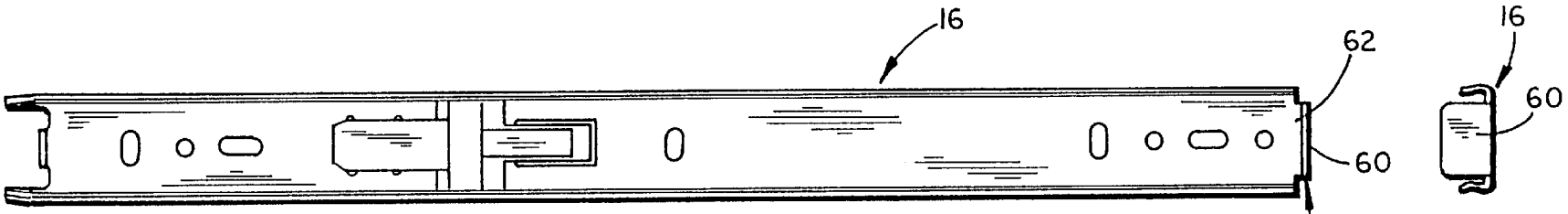
FIG.7A
FIG.7
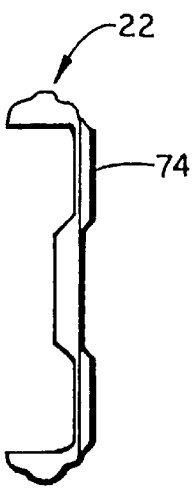
FIG.9A
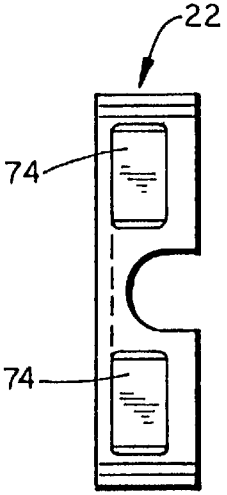
FIG.8A
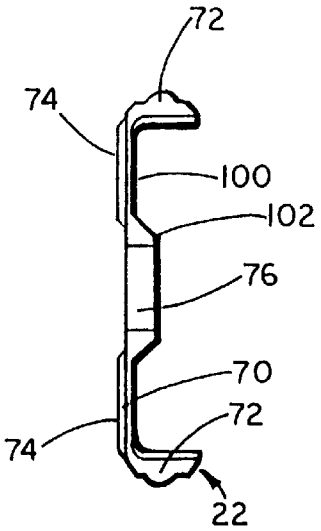
FIG.9
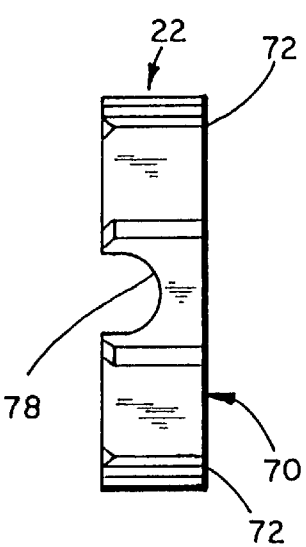
FIG.8

DRAWER SLIDE ASSEMBLY

This is a continuation of application Ser. No. 08/583,758 filed on Jan. 11, 1996, (now U.S. Pat. No. 5,868,479) which is a continuation of application Ser. No. 08/109,690 filed on Aug. 20, 1993, (now U.S. Pat. No. 5,507,571) which is a CIP of application Ser. No. 07/934,423 filed Aug. 24, 1992, (now U.S. Pat. No. 5,316,389) and a CIP of application Ser. No. 07/932,718 filed Aug. 20, 1992, abn. which was refiled as FWC Ser. No. 233,531 on Apr. 26, 1994 (now U.S. Pat. No. 5,472,272).

FIELD OF THE INVENTION

The present invention relates to a drawer slide comprising a cabinet channel, a center channel and a drawer channel, with interconnecting inner and outer ball bearing retainer assemblies.

BACKGROUND OF THE INVENTION

Such drawer slides are typically known as precision drawer slides. The applications for such drawer slides include loads and drawer sizes that are considered to be among the most severe and substantial in the drawer slide industry. In order to insure that drawer slide capacity is adequate, the multiple channel members are used to distribute the vertical loading evenly while providing a smooth opening and closing operation. For example, three channel members may be used. The channel members include a cabinet channel, a center channel and a drawer channel. The channels are engaged to operate in a telescoping fashion. While the conventional precision slide of this type employs three channel members, it is not inconceivable that more than three members could be used.

The functional movement of the drawer slide is designed to facilitate the opening and closing of a drawer within a cabinet structure. The telescoping action of this type of drawer slide accomplishes the opening and closing function smoothly and with little effort. As may be appreciated, the opening function terminates when the telescoping elements of the drawer slide reach the end, or termination point, of the travel. This termination point is determined by components of the drawer slide which are not a subject of the present invention, but which are collectively known as "out-stop" features. The "out-stop" features in such drawer slides stop the forward progress of the slide at a predetermined point, which usually occurs when the drawer is fully open.

The reverse situation occurs when the drawer is closed and the slide is returned to a fully retracted position, wherein the channels are in substantial alignment with each other. This is known as the "in-stop" function, and is somewhat similar to the out-stop function, in that drawer travel to the retracted position is halted at a preselected point. However, the considerations for "in-stop" protection are somewhat different than for "out-stop" protection. The objective for in-stop protection is to prevent damage from occurring between the drawer front and the cabinet face or frame. In-stop features allow the drawer to be stopped, by acting through the elements of the drawer slide itself, which transfers the stopping force to the frame or side walls of the cabinet.

Drawer slides are known which utilize an in-stop feature positioned toward the rear of the installed cabinet member. Typically, these well-known in-stop designs comprise a metal tab which is turned upwardly into the center part of the channel area so as to form a positive obstruction to the travel of the center channel thereby preventing it from traveling into the cabinet enclosure after the center channel contacts the obstruction. Refinements on this approach have occurred primarily in the area of providing a resilient covering around the metal tab so as to lessen the impact on the center channel.

The in-stop function may also include a rear mounted stop in the center channel, again comprising tabs that can be folded into position to obstruct travel of the drawer member. In this fashion, the combination of stops on both the center channel and the cabinet channel work in cooperation to provide a positive in-stop feature that approximates the desired closed positioning of the drawer within the cabinet frame. However, this approach has deficiencies.

The problems which have plagued the in-stops of the prior art result from both the location and the construction of the in-stop components. Specifically, the metal tab, which is turned 90° to provide obstruction to travel of an adjacent channel, is subject to deformation where extreme closing force is generated when a drawer is closed quickly, as would be the case in a fully loaded drawer. The in-stop devices taught by the prior art may be inelastically deformed, thereby changing the stopping position of the drawer slide. In addition, placement of the in-stop elements at the rear portion of the slide increases the potential for error in seeing the actual stopping point of the drawer. For example, in a drawer slide with a cabinet channel length of 18 inches, the in-stop components of the drawer slide are located close to 18 inches away from the front of the cabinet and the drawer face. Imperfections in manufacturing or materials introduce tolerance factors which can materially affect the accuracy of the stopping position of the drawer from cabinet to cabinet.

There are other drawer slide configurations that differ from the three channel telescoping product described above. For example, there are two channel member slides with in-stop functions similar to those described above. It should therefore be appreciated that the teachings of the present invention are applicable to drawer slides employing two channel members or more, wherever a compatible telescoping operation of channels is found.

SUMMARY OF THE INVENTION

The present invention is drawn towards a new method of providing an in-stop function for drawer slides with telescoping channels which overcome the problems of prior art drawer slides. One aspect of the drawer slide according to the present invention includes a cabinet channel, a center channel and a drawer channel which are all slidably coupled to each other and move telescopically, from a retracted position to an open position. The drawer slide includes a cabinet channel stop, a center channel stop and a drawer channel stop for stopping the channels at a preselected position.

According to narrower aspects of the invention, an end bumper engages the drawer channel and retains it in the retracted position until overcome by the initial force required to open the drawer. A cabinet stop provides anti-scrape protection between the center channel and the cabinet channel as the drawer slide is operated under conditions where loads may distort the available clearance between these channels.

It is therefore an object of the present invention to provide for a drawer slide with an in-stop function oriented toward the outer ends of the slide members so as to accurately position the channel members each time the drawer is moved to the closed position. It is also an object of the present invention to provide for a drawer slide with a positive closure mechanism.

Further, it is an object of the present invention to protect the cabinet channel, and the immediately adjacent channel member running within it, from injurious contact with each other. The drawer slide of the present invention includes in-stop components directly in the vicinity of the stopping position. The elements, as will be seen below, are also resistant to deformation and thus retain their precision stopping characteristics throughout the life of the product, notwithstanding the imposition of severe closing force on the drawer slide.

BRIEF DESCRIPTION OF THE DRAWINGS

FIG. 7 is a side elevational view of a drawer channel of the present invention;

FIG. 7A is an end elevational view of the drawer channel of FIG. 7;

FIGS. 8 and 8A are opposite side elevational views of a cabinet channel stop of the present invention;

FIGS. 9 and 9A are opposite end elevational views of the cabinet channel stop of FIG. 8;

DETAILED DESCRIPTION OF THE PREFERRED EMBODIMENTS

Figure 1:
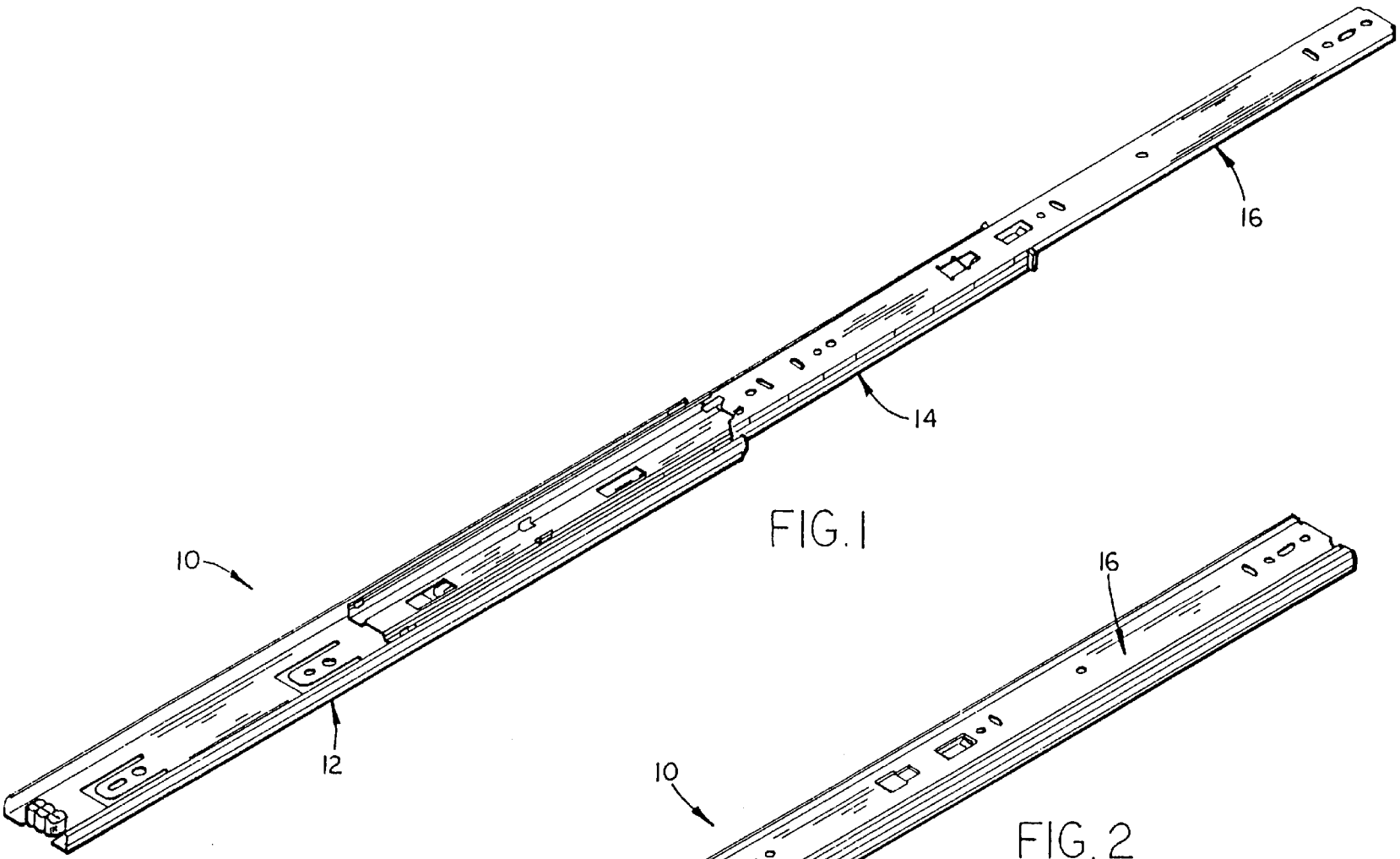
FIG. 1 shows a perspective view of a drawer slide of the present invention in the fully extended or open position.
Figure 2:
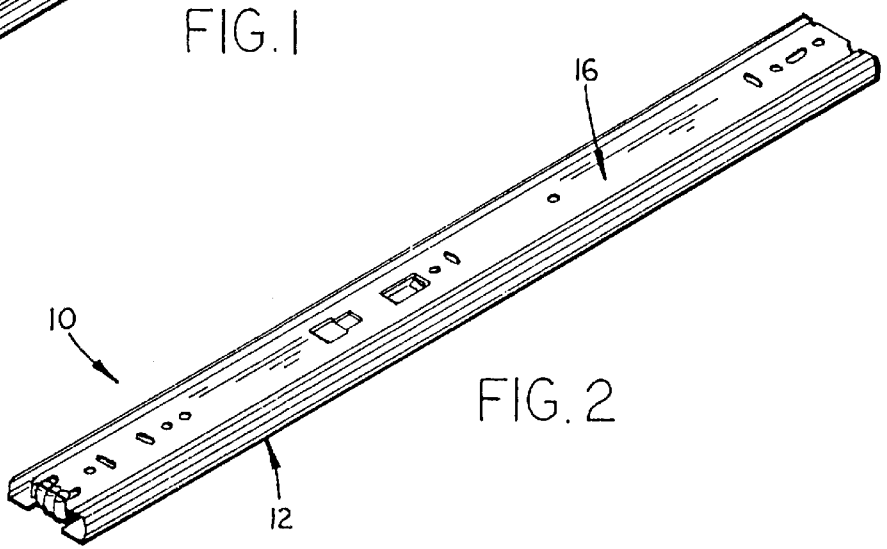
FIG. 2 is the same view as in FIG. 1 with the drawer slide in the retracted or fully closed position.
Figures 3, 3A, 6, 6A, 6B, 6C, 6D:
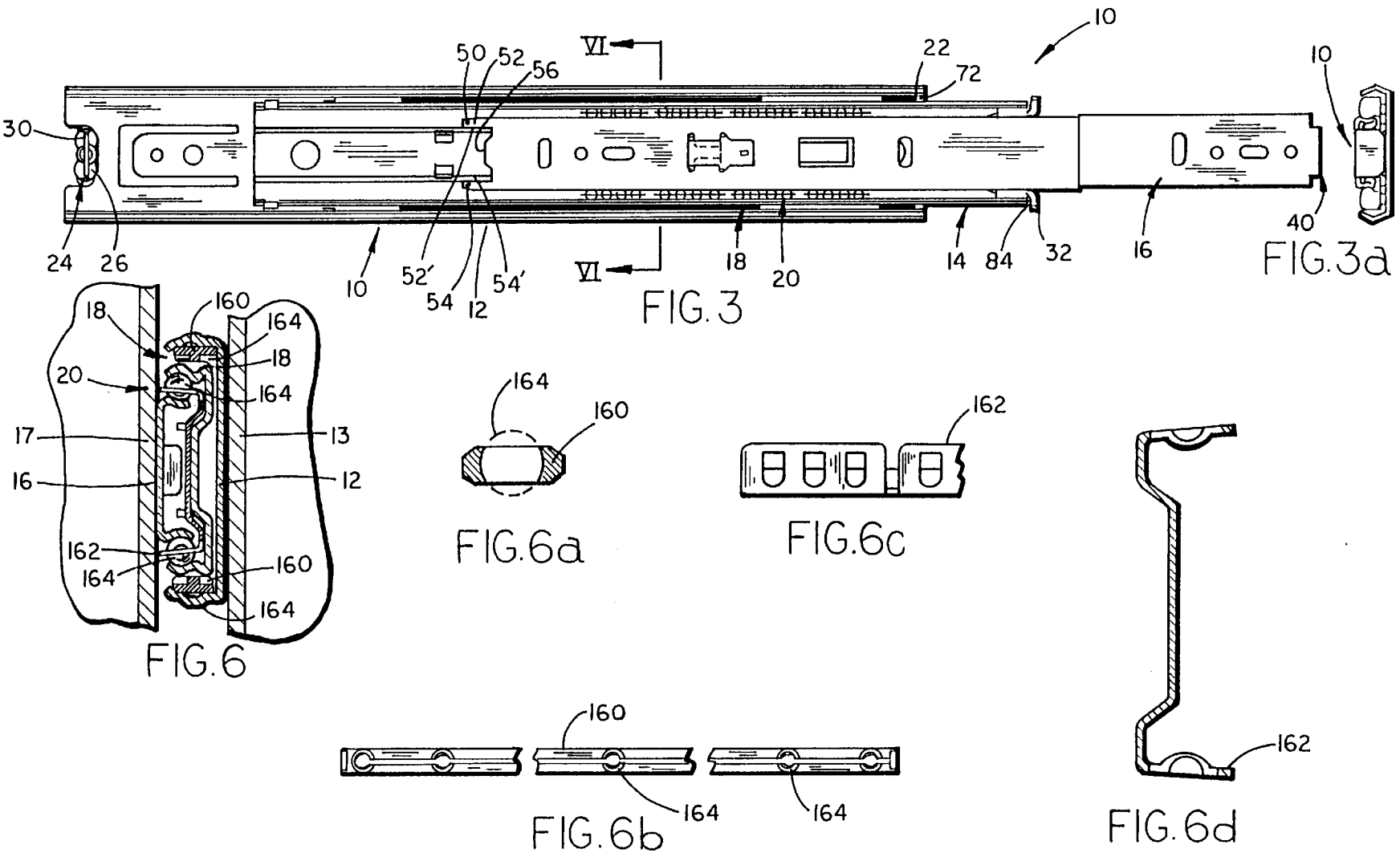
FIG. 3 is a side elevational view of a drawer slide of the present invention in a partially open position.
FIG. 3A is an end elevational view of the drawer slide of FIG. 3.
FIG. 6 is a cross section of FIG. 3, taken at VI—VI, disclosing a portion of the assembled components of a drawer slide of the present invention.
FIGS. 6A, 6B, 6C and 6D are views of the bearing holder and bearings positioned between the channels of the drawer slide according to FIGS. 1–3.
Figure 4:
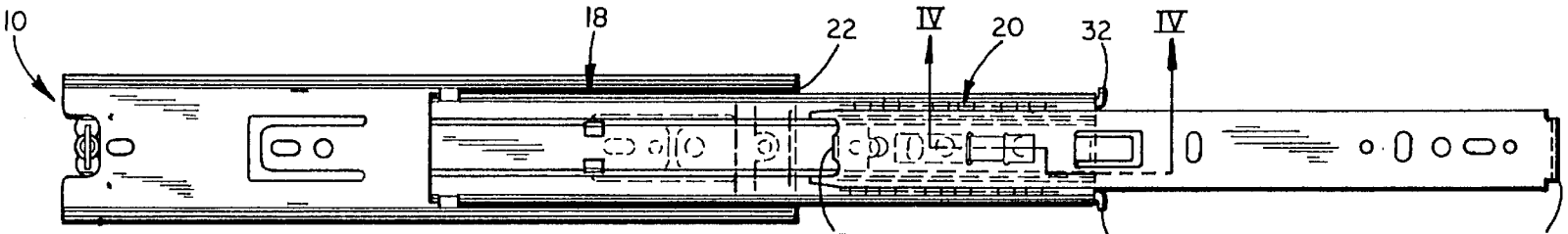
FIG. 4 is a similar view of a drawer slide in FIG. 3 with certain in-stop features shown in phantom, for clarity.

A drawer slide 10 comprising the present invention is shown in FIGS. 1, 2 and 3. In FIG. 1, drawer slide 10 of the type incorporating the present invention is shown in a perspective view in the open position. In FIG. 2, a drawer slide of the present invention is shown in the closed position. The drawer slide 10 is described in greater detail in co-pending U.S. Pat. No. 5,316,389 and U.S. patent application Ser. No. 07/932,718, the disclosures of which are incorporated herein by reference. However, a general description of the drawer slide is provided herein.

Figure 12C:
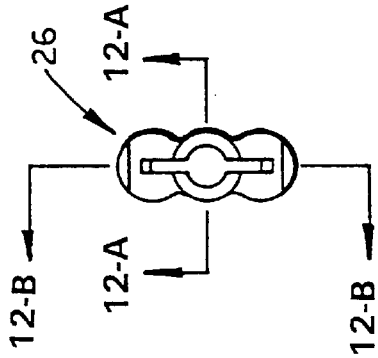
FIG. 12C is a top plan view of the bumper cushion of FIG. 12.
Figure 12B:
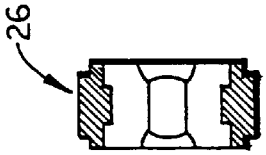
FIG. 12B is a cross-sectional view taken along plane B—B in FIG. 12C.
Figure 12A:
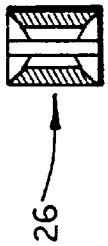
FIG. 12A is a cross-sectional view of the bumper pad according to FIG. 12C taken along plane A—A.
Figure 12:
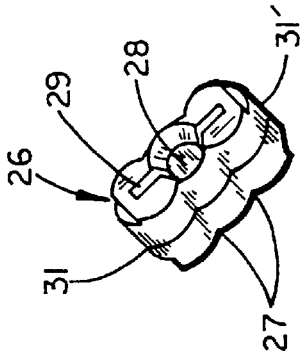
FIG. 12 is a perspective view of a bumper cushion utilized for the drawer slide according to FIGS. 1–3.

Turning now with particularity to FIG. 3, a precision drawer slide 10 is comprised generally of cabinet channel 12, center channel 14 and drawer channel 16. Also shown in the drawing are outer ball bearing assembly 18 between channels 12 and 14 and inner ball bearing assembly 20 between channels 14 and 16. Positioned on the cabinet channel are the cabinet channel stop 22 and the end bumper 24. End bumper 24 includes a bumper cushion 26, a bumper cushion hole 28 (FIG. 12), and cushion mount 30 (FIG. 12). The center channel includes a center channel stop 32. The drawer channel includes a drawer channel stop 40. The drawer channel also includes a drawer channel end 50 with drawer channel end member top 52 and drawer channel end member bottom 54. The end member top and bottom, respectively, include end surface top 52' and end surface bottom 54'.

With reference to FIG. 7, the drawer channel 16 includes drawer channel stop 40 which is comprised of the drawer channel stop tab 60 with stop tab cushion 62. The cabinet channel stop 22 is more completely disclosed in FIGS. 8, 8*a*, 9 and 9*a* which show cabinet stop edge 70, cabinet stop face 72, cabinet stop bottom 74, cabinet stop guide surface 76 and cabinet stop recess 78. Center channel stop 32 is more completely shown in FIGS. 10, 11, 11*a*, 11*b* and 11*c*. The center channel stop 32 includes center channel stop flange 80, center channel stop flange edge 82, center channel stop face 84, center channel stop bottom 86, center channel stop flange support 88 and center channel stop edge face 90.

More particularly, the cabinet channel stop 22 (FIG. 13) has a generally contoured shape designed to fit within the inner profile of the cabinet channel 12. In the installed position, the cabinet stop bottom projection 74 (FIG. 9) engage the inner surface of the cabinet channel. The cabinet stop has recessed surfaces 100 and raised surface 102 which are presented to the center channel 14 (FIG. 6). The center channel member has a profile, or cross section, which is compatible with surfaces 100, 102 (as best illustrated in FIG. 6). The center channel is therefore free to travel its longitudinal path back and forth within the profile described by the inner surfaces 100, 102 of the cabinet stop 22. At times, when excessive loads or forces are applied to the drawer slide assembly, it is possible that position of the center channel can be altered somewhat, causing it to contact the inner surfaces of the cabinet stop 22 itself. In the prior art, such contact, which was metal on metal, was deleterious to the slide and contributed to its early failure. In the present case, this problem is overcome by using a plastic material for construction of the cabinet channel stop 22, which has favorable characteristics for such abrasive contact. In particular, a preferred material would be a nylon such as Dupont Zytel 8018 Nylon. This material provides an anti-scrape function that promotes smooth operation of the drawer slide even under excessive load conditions. The advancement of this anti-scrape function over the prior art is the lack of metal-to-metal contact, such that friction between the center channel and the cabinet channel is lowered, preventing damage to the channel members.

Figures 13, 14:
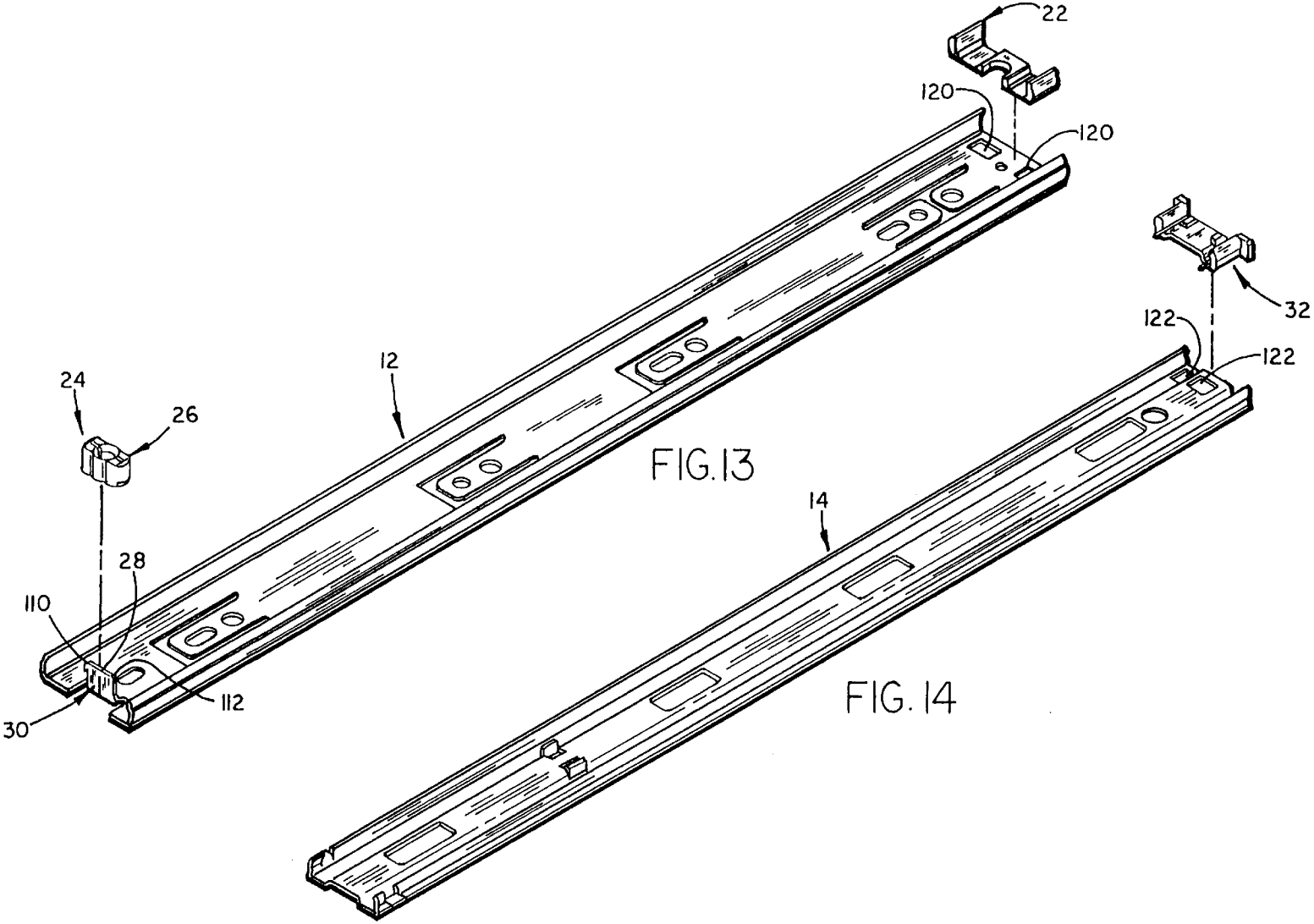
FIG. 13 is an exploded perspective view of a drawer slide cabinet channel for the drawer slide according to FIGS. 1–3.
FIG. 14 is an exploded perspective view of a center channel for the drawer slide according to FIGS. 1–3.

As shown in FIG. 13, the channel stop 22 is inserted into cabinet channel 12 on the outer end, opposite end bumper 24. The channel stop 22 includes generally rectangular cabinet stop bottom projections 74 which are inserted into respective apertures 120 in the cabinet channel 12. The stop may be secured to the cabinet channel 12 using a suitable adhesive, a threaded fastener (not shown), or the like. Cabinet channel stop 22 fits snugly within the cabinet 12 and is manufactured of a suitable polymer. The center channel 14 fits within the U-shaped profile of channel stop 22 to nest compatibly therebetween due to the conforming contours of the channel stop 22, the cabinet channel 12 and the center channel 14.

The center channel stop 32 is contoured for mating, snug engagement with center channel 14, as shown in FIG. 14. To effect this snug relationship, the center channel stop 32 is contoured to mate with conforming surfaces on the center channel 14. The center channel stop 32 also includes a center channel stop bottom 86 (FIG. 11) received in aperture 122 (FIG. 14) of center channel 14. The center channel stop is preferably manufactured of a suitable polymer.

Figures 15, 16:
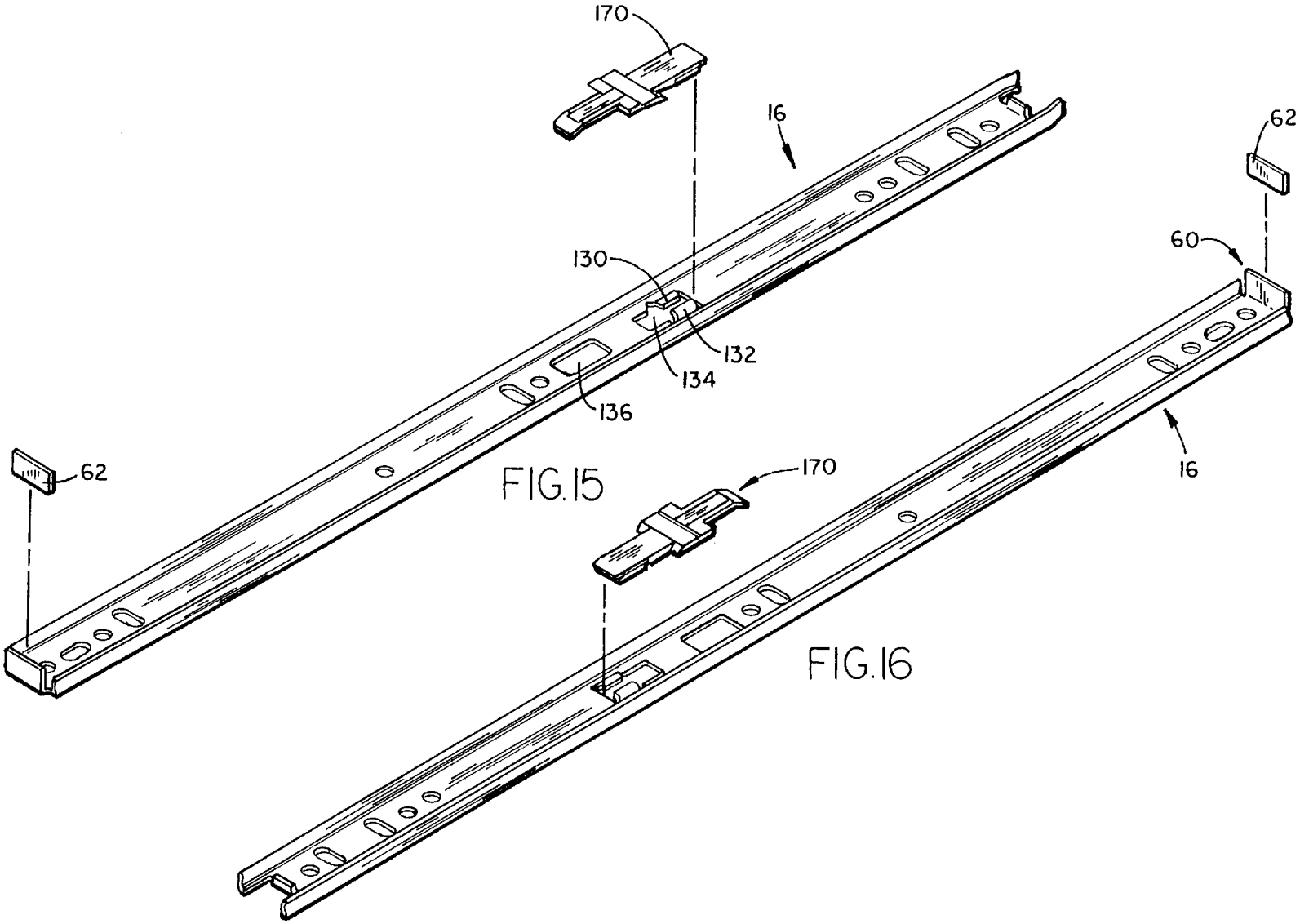
FIG. 15 is an exploded perspective view of a drawer channel for the drawer slide according to FIGS. 1–3.
FIG. 16 is an opposite exploded perspective view of the drawer channel for the draw slide according to FIGS. 1–3.
Figure 17:
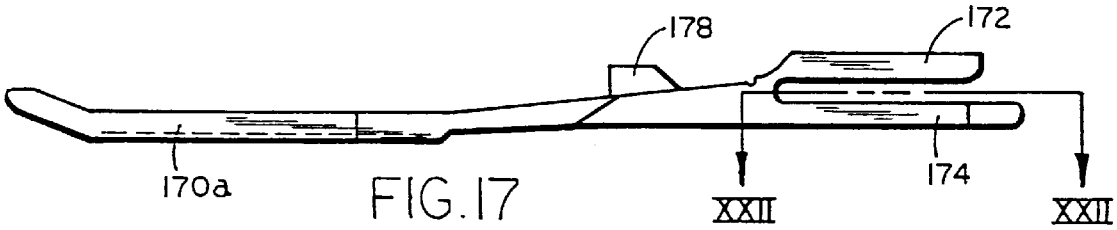
FIG. 17 is an enlarged side elevational view of a stop lever.
Figure 18:
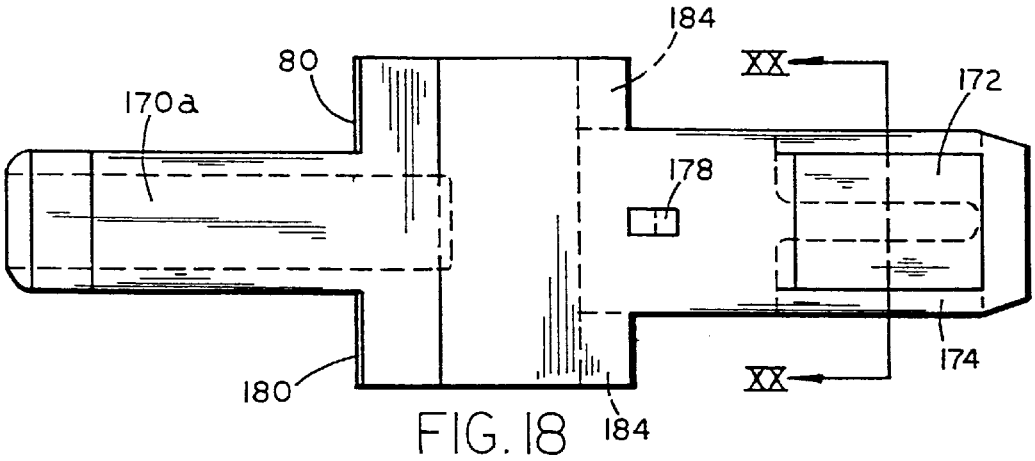
FIG. 18 is a plan view of the stop lever according to FIG. 17.
Figure 20:
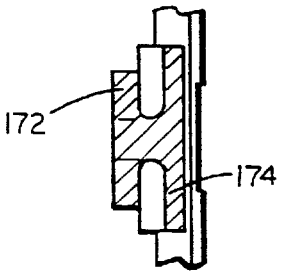
FIG. 20 is an enlarged fragmentary sectional view of the stop lever taken along plane XX—XX in FIG. 18.
Figure 19:
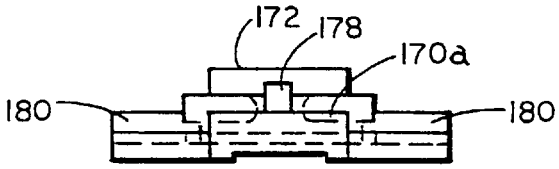
FIG. 19 is an end elevational view of the stop lever according to FIG. 17.
Figure 22:
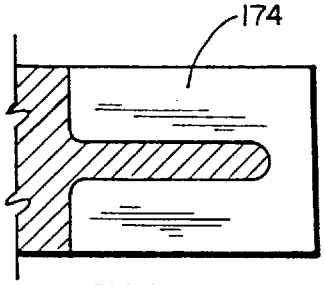
FIG. 22 is an enlarged fragmentary sectional view of the stop lever taken along plane XXII—XXII in FIG. 17.
Figure 21:
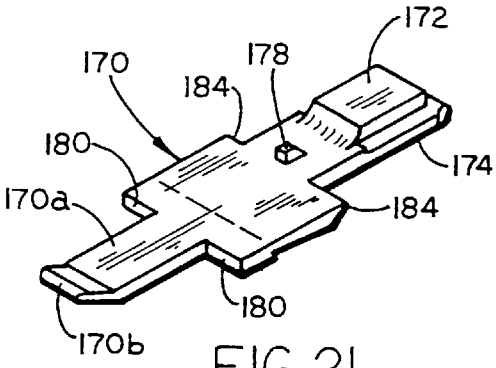
FIG. 21 is an enlarged perspective view of the stop lever according to FIG. 17.

The drawer member includes stop tab cushion 62 and stop lever 170, as shown in FIG. 15. As described above, the stop tab cushion 62 is attached to stop tab 60 using an adhesive. The center channel 14 includes tangs 130 and 132 which slope toward each other to receive the stop lever 170. Stop lever 170 is a polymeric, elongated member with several portions being of one integral molded structure. It has a rear mounting end of a fork-shaped configuration with one flange 172 thereof being an integral extension of the body of the element, and the other flange 174 being spaced from the first flange, parallel thereto, and defining a slide therebetween slidably to receive mounting tangs 130 and 132 of the central channel 16. Upon complete insertion of tangs 130, 132, a laterally protruding retention abutment 178 (FIGS. 17, 18, 19 and 21) engages into a slot 134 to keep the slot lever in cooperative association mounted on center panel 14 until it is to be purposely removed. Removal is by depression of abutment 178 to force it out of engagement with center channel 14 and thereby to allow the lever to be slid back out of its snapped in relationship with rail 14.

Center channel 14 also preferably includes an opening 136 adjacent the terminal trigger portion 170*a* of lever 170 when the lever is fully installed to provide more space for the trigger to be resiliently laterally depressed and thereby release the stop mechanism. This trigger 178 also preferably includes a diagonally extending terminal or end portion 170*b* which is at an obtuse angle relative to portion 170*a* that is generally parallel to center channel 14. End portion 170*b* therefore projects slightly toward the inner channel wall and toward window 136 if one is used. An alternate stop lever is shown in FIG. 16 of the parent application Ser. No. 07/934,423, incorporated herein by reference, and therefore is not described in greater detail herein. The stop lever includes shoulders 180 and a pair of diagonal ramping surfaces 184 which cooperate with a similarly arranged pair of ramping shoulders on lugs of the center channel for ease of assembly. These ramp the stop lever with a temporary bias to allow passage of the stop surfaces.

The channels include rails of a generally C-shaped cross section as is commonly done. That is, the outer channel 12 has a main vertically mounted panel, an upper generally horizontally extending leg and a lower generally extending horizontal leg. In the legs, arcuate radius concave ball bearings 164 (FIGS. 6*a*, 6*b*) are received in raceways or tracks of the cabinet, center, and drawer channels. These ball bearings are in a series, axially spaced from each other by Nylon retainer 60 and metal retainer 162 which are press-fit into the channels to hold the bearings 164 between the rollers. A further description of these arrangements, together with the advantages thereof, are set forth in co-pending application Ser. Nos. 07/934,423 and 07/932,718 incorporated herein by reference. However, it is noted that these members may be readily removed, along with the other plastic components of the system, using tools.

A drawer slide of the present invention functions by the telescoping longitudinal operation of the channels 12, 14, 16, as shown in FIGS. 1–3. This movement between an open and closed position facilitates the action of opening and closing a drawer within a cabinet structure. Neither the drawer nor cabinet need be shown to understand the invention. In general, it will be recognized that the drawer 17 (FIG. 6) is mounted to the drawer channel 16, which is supported in the center channel 14 which, in turn, is supported in the cabinet channel 12, which is interconnected to the cabinet 13. The drawer slide of the present invention provides a better method for insuring that operation of the drawer slide positions the drawer in desired alignment with the cabinet frame or face, and thereafter retains it in the closed position and, when being operated, retards the scraping that may occur between the cabinet member and the center member.

Figure 5:
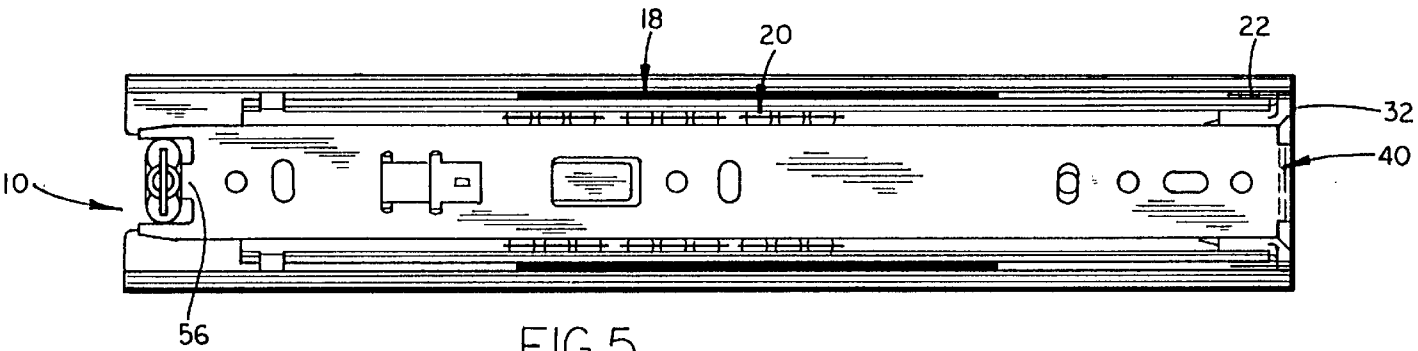
FIG. 5 is a similar view of the drawer slide in FIG. 4 with the drawer slide in the closed position.
Figure 5A:
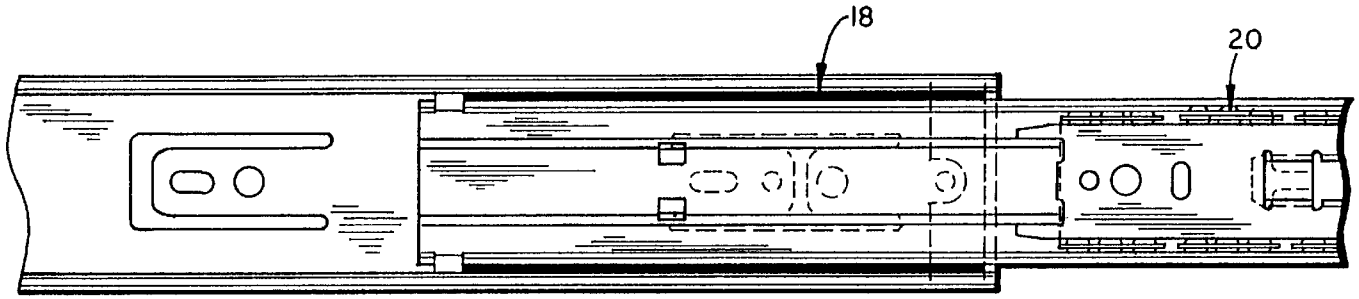
FIG. 5A is a fragmentary view of the drawer slide assembly similar to the view of the drawer slide according to FIG. 5 with the drawer slide assembly extended.
Figure 11A:
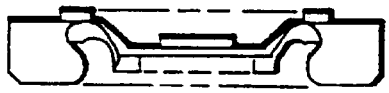
FIG. 11A is a front end elevational view of the center channel stop of FIG. 11.
Figure 11:
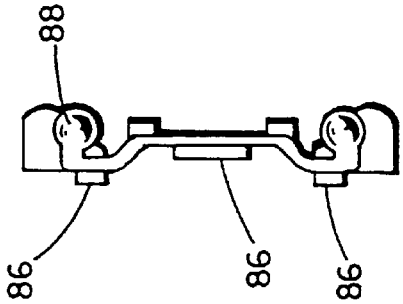
FIG. 11 is a rear end elevational view of the center channel stop according to FIG. 10.
Figure 10A:
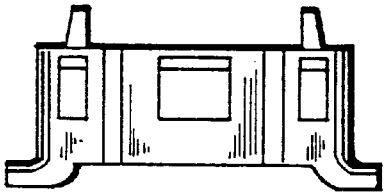
FIGS. 10 and 10A are opposite side elevational views of a center channel stop of the present invention.
Figure 10:
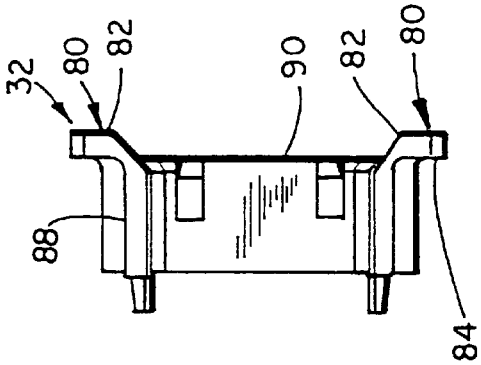

Specifically, the in-stop function of the present invention is designed to precisely align the drawer in the same stop position time after time. In the extended position shown in FIG. 3, cabinet channel stop 22, center channel stop 32 and drawer channel stop 40 are in their installed positions but have yet to make contact. As the drawer slide is retracted or closed, ultimately a position is obtained as shown in FIG. 5. As can be seen, the three channel stops 22, 32, 40 are now butted against each other and prevent further motion of the slide as a whole toward the retracted position. In particular, the cabinet stop edge 70 (FIGS. 8 and 9) is generally described as that front portion of the cabinet stop 22 at large. It includes the cabinet stop face 72 of channel 22 which is the actual surface which contacts the corresponding center channel stop face 84 of channel stop 32.

As can be seen from drawings FIG. 5, the two faces 72, 84 are in such alignment that they have substantial contact between them. Given the in-stop function, the direction of force is directed onto the surface of the cabinet stop face 72 and is resisted by the installed cabinet channel stop 22 as a whole. The cabinet channel stop bottom portions 74 are insertable into features in the cabinet channel 120 (FIG. 13) as described above and are retained therein, such that cabinet channel stop will not move laterally. It will be appreciated that there are a number of different ways to affix the cabinet stop, or any of the other stops, to the appropriate channel member. In this case, the cabinet stop bottoms 74 are press fit into receiving holes 120 found on the cabinet channel, and the overall contours of the cabinet stop also fit the inner cross-sectional profile of the cabinet channel. It would be just as feasible for one to practice the invention by riveting or screwing the cabinet channel stop 22 to the channel 14, or use of some other means such as gluing or staking.

The center channel stop 32 (FIG. 5) participates in two different functions in the in-stop operation. Commencing first with the stopping function between the center channel 14 and the cabinet channel 12, the center channel stop face 84 (FIG. 10) is the surface that contacts the cabinet stop face 72 (FIG. 9). As the slide is closed, the center channel 14 advances toward the rear of the installed drawer assembly and continues to do so until its travel is stopped by contact between the center channel stop 32 and the cabinet channel stop 22. As mentioned previously, the stops are affixed to their respective channel member and are capable of resisting the closing force that might be asserted. In the case of the in-stop action between the cabinet channel and the center channel, the closing force is exerted on the center channel stop face 84 and is directed toward the inner end of the installed drawer slide assembly.

The second part of the in-stop function attributable to the center channel stop 32 (FIG. 5) comes from the interaction between the center channel stop 32 and the drawer channel stop 40. In similar fashion as has just been described, the edge face 90 (FIG. 10) on the center channel stop is the contacting surface for the drawer stop 40. As the closing of a drawer progresses, the drawer channel 16 retracts, as has been the case with the center channel 14, until such point as the drawer channel stop 40 contacts the center channel stop 16 and can no longer travel. The drawer channel stop tab 60 is shown in the present embodiment as a turned up portion of the drawer channel itself. This metal projection has a stop cushion 62 affixed to it, typically glued, and it is the cushion that is the stopping contact between the drawer channel stop 40 and the center channel stop 32. Cushion 62 meets the edge face 90 of the center channel stop 32. Cushion 62 softens the impact, thereby diffusing some of the closing force and reducing the amount of closing force that is transferred to the drawer (not shown) and the cabinet frame (not shown).

It is noted that the construction of the various cabinet stops 22, 32, 62 contemplates the forces to which they will be subjected. Fastening of the stop to the particular channel members 12, 14, 16, as has been described above, has to sufficiently resist the closing force in order to practice the present invention. The reason for this is the closing force is transmitted to the channels 12, 14, 16, and thereafter to the cabinet frame (not shown) or side wall, and the drawer (not shown) itself. Unlike the prior art, the present embodiment distributes the closing force across a substantial portion of the cross-sectional area of the channel member, with the exception of the drawer stop. In the case of the drawer stop, however, the drawer stop tab is subjected to a smaller portion of the total closing force than the cabinet channel stop. As a result, there is little danger that the stop tab on the drawer channel will ever deform and cause the stop position to change.

As can be seen in FIG. 5, the final stopping position which has been selected results from alignment of the cabinet stop 22, the center stop 32 and the drawer stop 40. In the preferred embodiment, desired alignment occurs when the drawer channel stop 40 is flush with the outer edge of the cabinet channel 14. It is an important result of the present invention that the stopping position defined by the fully closed elements of the drawer slide remain the same over the lifetime of the product in actual use. As a result, diffusion of the closing forces, particularly by the cabinet channel stop 22 and the center channel stop 32, eliminates the deformation which has been known to occur with the cabinet channel stop of the prior art.

It can now be appreciated that placement of the stop elements 22, 32, 40 at the outer end of the drawer slide assembly results in better control of the accuracy of the stopping point. The reason for this, in part, is the channel stops 22, 32, 40 are on the outer end of the drawer slide, whereas the prior art utilities stops controlling a stopping point at the inner end of the drawer slide. Many tolerances in formation of the length of the channels, interrelation of the individual channel members to each other, as well as other characteristics of the prior art drawer slides, accumulate to increase variations in the actual stopping point that will be realized upon final assembly of the prior art drawer slide to the cabinet. In the present embodiment, the accumulation of such variations in manufacturing is minimized since the in-stop members are on the outer edge of each channel member. Thus, overall variations in the actual length of the channel members has no influence on the stopping point.

Another component that participates in the in-stop operation of the preferred embodiment is associated with interaction between the inner end 50 of drawer channel 16 (FIG. 3) and the end bumper 24 attached to the cabinet channel. While the actual instop function is performed by the channel stops 22, 32, 40 described above, the end bumper 24 and inner drawer channel end 50 augment the function by providing a retaining engagement of the drawer slide channel of the end bumper when the drawer channel is moved to the fully closed position. As can be seen in FIGS. 3 and 5, the drawer channel end moves from a position of non-engagement when it is open to a position where the drawer channel end 50 engages the end bumper 24. Specifically, the drawer channel end top member 52 and bottom member 54, have corresponding top surface and bottom surface that grip corresponding areas on the bumper cushion 26. The bumper cushion 26 itself is made of a suitable integrally molded polymer, and is preferably manufactured from a resilient material such as a urethane. In the preferred embodiment, the plastic for the bumper cushion 26 is manufactured from Dupont Hytrel. The bumper cushion 26 is elastically deformable to the extent that repeated squeezing by the drawer channel end members will not materially affect its performance. As can be seen in FIGS. 3 and 5, in the closed position the door channel members 52, 54 squeeze the upper and lower radiuses of the bumper cushion 26 just slightly so as to generate a gripping bias that tends to retain the drawer channel member 16, and hence the center channel member 14, in the closed position. This bias results from the slight angle that is imparted to the drawer channel end members which are turned toward the longitudinal axis of the drawer slide.

In the preferred embodiment, the gripping force of the drawer channel 16 on the bumper cushion 26 is preferably on the order of 0.6 to 0.7 pounds. This gripping force may uniquely be retained over a substantial part, if not all, of the lifetime of the drawer slide. The reason for this stems from the selection of material, as well as the radiused design of the bumper cushion. With reference to FIG. 12, the bumper cushion hole 28 is substantially circular in shape, and extending therefrom are slots 29. In the preferred embodiment, the bumper cushion is inserted onto the cushion mount 30, the cushion mount 30 being a tab which is formed from the cabinet channel, and turned up 90°. The cushion mount 30 includes flanges 110 and 112 on a distal end thereof. The bumper cushion 26 may be press fitted onto the cushion mount, such that mount 30 passes through slots 29 with flanges 110, 112 retaining bumper 24, and it also may be affixed by using a suitable glue. In addition to the previously mentioned features, the bumper cushion also includes top radius 31 and bottom radius 31'. Along the sides of the bumper cushion are indentations 27. In the preferred embodiment, the bumper cushion is non-handed, which means that functionally speaking it will be installed correctly from top to bottom, and in an up or down position regardless of orientation.

The design of the bumper cushion facilitates its longevity as part of the retaining means. The "peanut" shape allows the radiused portions of the cushion 26 to flex as the drawer channel members engage it during the closing procedure. The bumper cushion hole is provided for another purpose altogether, however, and that is to act as a backup cushion in the event a second in-stop function is needed. As can be seen from FIGS. 3 and 5, the drawer channel tab 56 is in such alignment with the bumper cushion such that in the event the previously described in-stop function should be overcome, the drawer channel tab 56 will contact the end bumper 24 to provide a backup in-stop function. This secondary in-stop is a safety feature. In the preferred embodiment, a small clearance of about 1/32 inch is left between the drawer channel tab 56 and the bumper cushion when the drawer is fully closed. However, in the event an extreme closing force is applied, it is possible that the center channel stop flanges 32 may give slightly, causing the door channel tab 56 to contact the bumper cushion 26. The center channel stop flanges 32 will return to their normal position and the drawer channel will relocate in the proper stopping position following impact. In the event of contact of the drawer channel tab 56 with the end bumper 26, a certain amount of flexation occurs within the bumper cushion hole 28. This flexation helps to absorb some of the energy from the contact, thereby diffusing some of the closing force and reducing its potentially damaging effects on the drawer slide.

A significant advantage of the assembly is that the components will not scrape, metal on metal, even under torsional loads, because the polymeric components which serve the functions of stops and guides, also form guide bushings between the side elements.

In the foregoing description, it will be readily perceived by those skilled in the art that modifications may be made without departing from the concepts disclosed herein. Such modifications are to be considered included in the following claims, unless these claims by their language expressly state otherwise.

What is claimed is:

1. A drawer slide and a furniture article having a cabinet and a drawer, comprising:

a plurality of telescopically interconnected channel members, a first of said channel members directly mounted on the cabinet and a second of said channel members directly mounted to the drawer, said channel members supporting the drawer on the cabinet such that the channel members are movable between a fully retracted drawer closed position within said cabinet and a fully extended drawer open position;

said channel members each having an inner rearward end and an outer forward end, said outer forward end of said second channel extending out of said first channel in said extended, drawer open position;

a plurality of in-stop elements positioned on the forward outer end of said first and second channel members, one of said in-top elements including a polymeric guide body which is sandwiched between said channels when the channel members are in the fully closed position; and said plurality of in-stop elements being in cooperative engagement with each other when said channel members are in the fully closed position.

2. A drawer slide assembly comprising:

a plurality of telescopically interconnected channel members including a first channel member and a second channel member, said channel members adapted to support a drawer on a cabinet such that the channel members are movable between a fully retracted drawer closed position and a fully extended drawer open position;

said second channel member being generally C-shaped including a top wall, a side wall, and a bottom wall;

a polymeric anti-scrape guide bushing disposed at the outer end of said first channel member and disposed to selectively contact at least one of said top wall and said bottom wall of said second channel member and having a profile conforming to the contours of said first and second channel members.

3. A drawer slide assembly defined in claim 2 wherein said guide bushing has a first in-stop surface thereon, said second channel member has a second in-stop surface carried thereon and disposed to contact said first in-stop surface when said channel members are in a drawer closed position.

4. A drawer slide assembly defined in claim 2 wherein said drawer slide assembly comprises at least three channel members, said polymeric anti-scrape guide bushing disposed at the outer ends of at least two of said channel members.

5. A drawer slide assembly defined in claim 2 wherein said first channel member has an outer lip, and said guide bushing is a self-lubricating polymeric material and is disposed at said outer lip of said first channel member.

* * * * *